US009254896B2

(12) United States Patent
Bertalan et al.

(10) Patent No.: US 9,254,896 B2
(45) Date of Patent: Feb. 9, 2016

(54) BALLAST SYSTEM AND RELATED METHODS

(71) Applicant: Medallion Instrumentation Systems, LLC, Spring Lake, MI (US)

(72) Inventors: Richard P. Bertalan, Norton Shores, MI (US); Scott Douglas Frye, Muskegon, MI (US)

(73) Assignee: Medallion Instrumentation Systems, LLC, Spring Lake, MI (US)

( * ) Notice: Subject to any disclaimer, the term of this patent is extended or adjusted under 35 U.S.C. 154(b) by 3 days.

(21) Appl. No.: 14/453,238

(22) Filed: Aug. 6, 2014

(65) Prior Publication Data

US 2015/0053127 A1 Feb. 26, 2015

Related U.S. Application Data

(60) Provisional application No. 61/867,866, filed on Aug. 20, 2013.

(51) Int. Cl.
*B63B 39/03* (2006.01)
*B63B 35/85* (2006.01)
*B63B 39/00* (2006.01)

(52) U.S. Cl.
CPC ..... *B63B 39/03* (2013.01); *B63B 39/00* (2013.01); *B63B 35/85* (2013.01)

(58) Field of Classification Search
CPC .. B63B 39/03; B63B 35/85; B63B 2035/855; B63B 15/00; B63B 17/00; B63B 21/56; B63B 13/00; B63B 35/81
USPC ..... 114/125, 242, 253
See application file for complete search history.

(56) References Cited

U.S. PATENT DOCUMENTS

| | | | | |
|---|---|---|---|---|
| 3,364,738 | A * | 1/1968 | Chadwick, Jr. et al. | 114/125 |
| 3,916,811 | A * | 11/1975 | Fromnick et al. | 114/125 |
| 5,979,350 | A * | 11/1999 | Larson | B63B 35/815 114/253 |
| 6,427,616 | B1 * | 8/2002 | Hagen | B63B 1/32 114/253 |
| 6,941,884 | B2 | 9/2005 | Moore | |
| 6,953,002 | B2 | 10/2005 | Jessen et al. | |
| 7,856,937 | B2 | 12/2010 | Chapdelaine et al. | |
| 8,534,214 | B1 | 9/2013 | Gasper | |
| 8,739,723 | B1 * | 6/2014 | Murphy | B63B 39/03 114/125 |
| 8,798,825 | B1 * | 8/2014 | Hartman | B63B 39/03 701/21 |

* cited by examiner

*Primary Examiner* — Lars A Olson
(74) *Attorney, Agent, or Firm* — Warner Norcross & Judd LLP

(57) ABSTRACT

A ballast system and method use a situational adaptive approach to measure, control and monitor the level of liquid in an onboard ballast tank. A baseline level of liquid in the tank, established while the watercraft is static, is stored in memory associated with a controller. While the watercraft is moving, the controller monitors pump conditions, e.g., run time, flow, vacuum, etc., and extrapolates the amount of water added to or drained from the tank. The baseline level and extrapolated added/drained amount are added to accurately determine the true liquid level in the tank. That information is displayed to the watercraft operator. The system can automatically adjust watercraft attitude by adding/draining water from the ballast tank based on preset values to provide a desired wake. The system can display ballast levels in volume, percentage of full, and weight; and can provide estimated times to achieve preset levels, empty or full.

17 Claims, 9 Drawing Sheets

BALLAST SYSTEM AND RELATED METHODS

BACKGROUND OF THE INVENTION

The present invention relates to watercraft, and more particularly to watercraft including a system that measures, controls and monitors the amount of liquid within a ballast tank of the watercraft.

Ballast systems are used in watercraft to control the attitude of the watercraft in the surrounding water. For example, ballast systems generally cause the watercraft to ride higher or lower in the water, displacing less or more surrounding water, respectively. In connection with performance or recreational watercraft used to waterski or wakeboard, rudimentary ballast systems exist to control the attitude of the watercraft, thereby achieving a particular wake behind the watercraft. This is of interest because a wake boarder or a water skier uses the wake created by the watercraft (and directly influenced by the ballast) as a ramp to launch themselves into the air and perform aerial feats.

Conventional ballast systems can be operated to adjust the volume of water in a ballast tank, by either adding or removing water from a ballast tank. The adjustment can compensate for passengers on the watercraft or can provide a desired adjustment to the attitude of the boat to meet a watersport athlete's wake preference behind the watercraft. An example of a recreational watercraft ballast system is shown in FIG. 1. There, the system includes ballast tank 10 and a water level sensor 20. Although not shown, the ballast tank can be filled or drained with fill and drain pumps, controlled by operator on/off switches run through an operating system of the watercraft. The sensor 10 provides feedback on the level of water in the ballast tank.

Ballast systems of watercraft as shown typically include only one water level sensor 20 per ballast tank 10. The sensor 20 usually is a float sensor and/or reed switch sensor having step functions between resistive contacts. Generally, such systems are plagued with inaccuracy where the watercraft is moving or in a dynamic state. Specifically, as shown in FIG. 2, the sensor 20 cannot identify the actual water level in the ballast tank 10 because the water in the tank is sloshing around, while the watercraft is moving, causing the float 21 of the sensor to move. Thus, the water level, in reference to where the sensor 20 and float 21 are located, rises and lowers erratically, based on movement of the watercraft.

As a result, the sensor and ballast system provide erroneous and/or inaccurate readings of the level of the water in the ballast tank, while the watercraft is moving. In turn, many times, the attitude of the watercraft is not adjusted properly, and a desired performance is not achieved. This can be particularly problematic where an operator is attempting to achieve a particular wake for wakeboarding, waterskiing or other recreational water activities. Further, the aforementioned issues are exacerbated where ballast tanks are triangular or of a complex polygonal shape, or where the ballast tanks are flexible membrane bags that are cylindrical or cuboid when filled.

SUMMARY OF THE INVENTION

A ballast system and method are provided to measure, monitor and/or control levels or amounts of liquid, such as water, in an onboard ballast tank of a watercraft. In turn, this functionality can be utilized to monitor, control and adjust the attitude of the watercraft relative to the surrounding water, particularly when the watercraft is in a dynamic state, moving through the water.

In one embodiment, the system and method can determine a baseline level (also referred to as an amount or volume herein) of liquid in the tank while the watercraft is static, optionally, moving through water at a rate less than 2 MPH or less than 5 MPH. That baseline amount can be acquired with a level sensor or pressure transducer located in or near the tank. The baseline level can be stored in memory associated with a controller, for example, a microprocessor, on the watercraft.

In another embodiment, the controller monitors one or more fill or drain pumps and/or the plumbing system associated with the ballast tank on the watercraft. The pumps and plumbing system are generally adapted to fill and/or drain the ballast tank. As an example, the controller can monitor a pump condition, such as a pump run time, input flow, output flow, vacuum, pressure, power draw, RPM, or other condition. Based on the monitored pump conditions, the controller can determine the transferred water amount of water added to or drained from the tank by the pump(s).

In still another embodiment, the controller accurately determines the total amount of water in the ballast tank while the watercraft is in the dynamic state, moving through the water. The determined amount or a representative value, such as volume, percentage of full, and/or weight can be displayed to an operator. The determined amount effectively accounts for both the static water amount and the transferred water amount to provide an accurate, real time reading of the total amount of water in the ballast tank, regardless of movement of the water in the ballast tank as the watercraft moves.

In yet another embodiment, the operator of the watercraft can review the display and alter the volume of water in the ballast tank based on the displayed value. For example, the operator can operate the pumps with switches to fill and/or drain water from the ballast tank while the watercraft is in the dynamic state so that the attitude of the watercraft is adjusted as the watercraft moves through surrounding water.

In even another embodiment, the system and method can be used to automatically adjust the attitude of the watercraft to a preselected attitude. This preselected attitude can correspond to the desired wake shape and size behind the watercraft as the watercraft moves through surrounding water. Optionally, the wake shape and size can be those preferred by a watersport athlete being towed behind the watercraft so that the athlete can perform certain feats in the wake.

In a further embodiment, the system and method automatically adjust the attitude in an automatic mode while the boat is moving at a rate greater than 2 MPH or greater than 5 MPH. This is accomplished by the controller receiving input from the operator of the watercraft, where the input is associated with a desired attitude of the watercraft. Based on this input, the controller operates one or more fill or drain pumps to transfer water to or from the ballast tank so the total amount of water in the ballast tank causes the watercraft to achieve the desired attitude of the watercraft.

In yet a further embodiment, while the controller operates the fill and/or drain pump(s) in the automatic mode, it monitors pump conditions and/or the plumbing system of the watercraft to determine the transferred water amount added to or drained from the tank. The precise transferred water amount for achieving a desired attitude of the watercraft can be closely metered by the controller operating the pump(s).

In still a further embodiment, the system can display the status of the ballast tanks, and the amounts of water therein, to the operator. The status can be displayed in various modes, such as volume, percentage full or empty and/or weight. The controller also can determine and display estimated time to achieve preselected attitude of the watercraft and/or values associated with the amount of water in the ballast tank.

In yet a further embodiment, the system and method can determine with the controller the static amount of water in the ballast tank while the watercraft is at rest. This can be done by using a software look up table, stored in flash memory, that relates a sensor level and a tank geometry. The static amount can be stored in non-volatile memory.

In still yet a further embodiment, the controller can monitor the amount of water in the ballast tank while the watercraft is moving during ballast fill and drain operations. As the watercraft moves, the controller recognizes fill and drain pump activations, and sets timers used to calculate the volume of water that is transferred to or from the tank by one or more pumps during sample periods. At end of each sampling period, the controller and its software can calculate the amount transferred, and adjust the tank level that is stored in memory for any future, further adjustments to the amount of water in the ballast tank.

In even yet a further embodiment, the controller measures the amount or volume of water in the ballast tank in a static state, and generates a static baseline water value associated with that amount or volume, whenever the electronic system and/or ignition of the watercraft is activated. This baseline value is accounted for along with any transferred value associated with water transferred to or from the tank, to establish accurate readings of the amount of water in the ballast tank, even as the watercraft is moving, and even when water is sloshing around in the ballast tank.

The present invention provides a system and method that can measure, monitor and/or control amounts of water in a ballast tank of a watercraft so that the attitude of the watercraft, and thus the size and shape of wake behind the watercraft, can be accurately and consistently adjusted, even when the watercraft is in a dynamic state, moving through the water.

These and other objects, advantages, and features of the invention will be more fully understood and appreciated by reference to the description of the current embodiment and the drawings.

Before the embodiments are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

BRIEF DESCRIPTION OF THE DRAWINGS

FIG. 8 is a flow chart illustrating operation of the controller when determining the amount of water transferred to the ballast tank in a fill condition, while the watercraft is in a dynamic state, in response to the fill pump being turned on;

FIG. 9 is a flow chart illustrating operation of the controller when determining the amount of water transferred from the ballast tank in a drain condition, while the watercraft is in a dynamic state, in response to the drain pump being turned on;

DESCRIPTION OF THE CURRENT EMBODIMENTS

I. Overview

Figure 1:
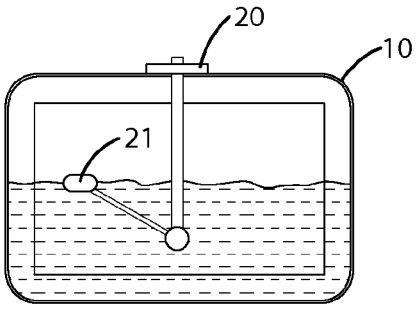
Fig. 1 (Prior Art)
FIG. 1 is a side view of a ballast tank and sensor of the prior art.
Figure 2:
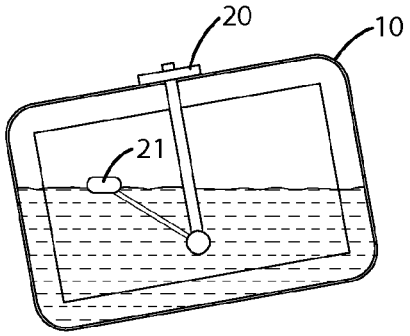
Fig. 2 (Prior Art)
FIG. 2 is a side view of a ballast tank and sensor of the prior art taking an erroneous reading of an amount of water in the ballast tank.

A current embodiment of the ballast system and method implemented on a watercraft is shown in FIGS. 1-10 and generally designated 110. The ballast system generally includes a ballast tank 106 within which a sensor 105 is positioned. A fill pump 104 and drain pump 107 are in fluid communication with the ballast tank 106 and capable of adding or draining water, respectively, to or from the ballast tank 106 via a plumbing system of the watercraft. A controller 102 is in electrical communication with the fill and drain pumps to monitor and control their status and operation. A fill switch 100 and a drain switch 101 are operable by user of the watercraft 120. The switches can be accessible buttons or included in a touch screen on a dashboard or other part of the watercraft 120. The controller is further in communication with a display 103 which can visibly display output and/or operation of the ballast system and any alterations thereof to the operator of the watercraft.

Figure 6:
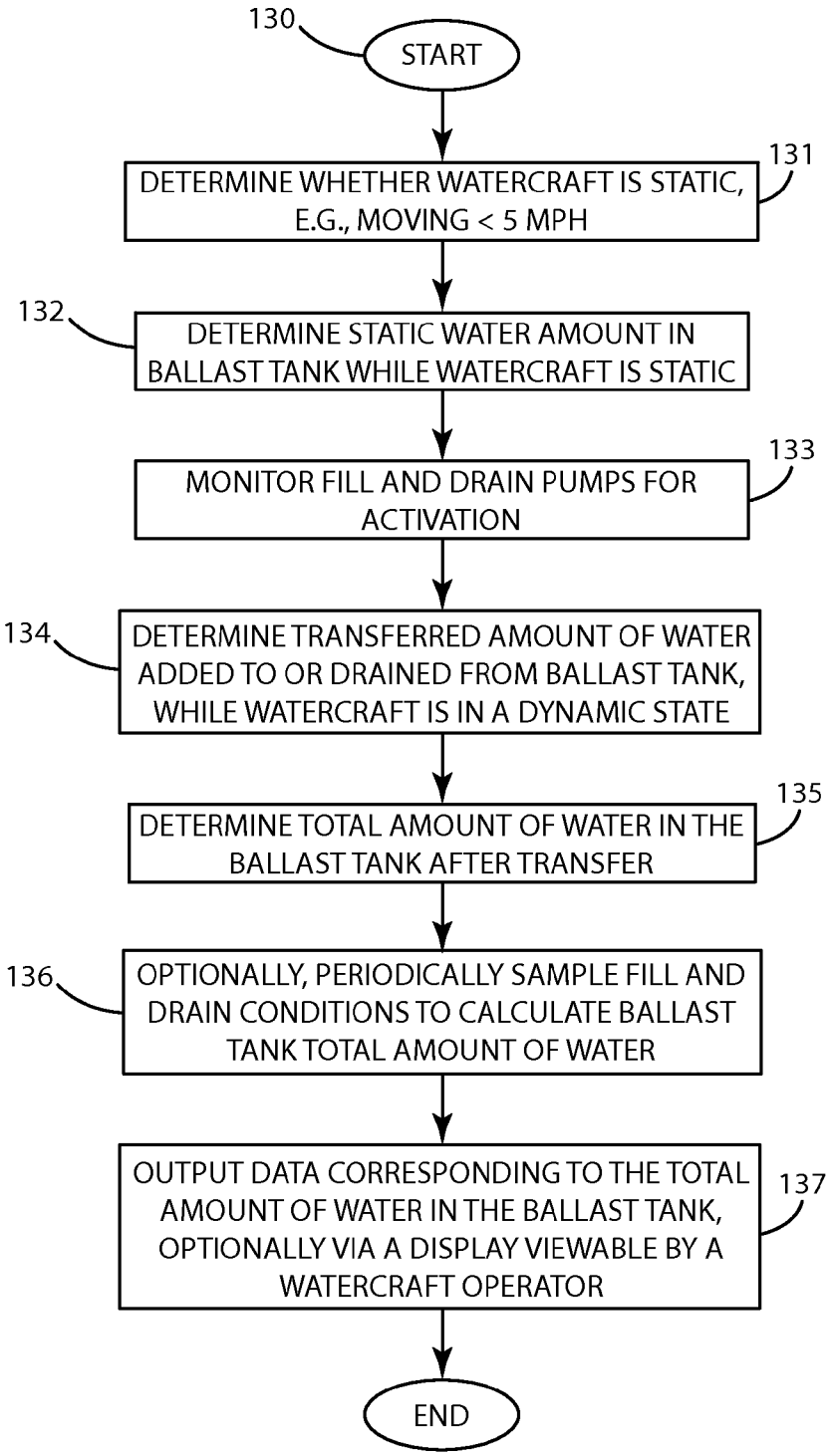
FIG. 6 is a flow chart illustrating operation of the ballast system under a method of the current embodiment.

As shown in FIG. 6, the ballast system 110 and particularly the controller 102 can carry out a method in which the controller determines the static baseline water amount, that is, the amount, volume, weight and/or other metric of liquid 109 in the ballast tank 106 when the watercraft is in a static condition, for example upon startup and/or actuation of the electronic system and/or ignition of the watercraft 120. For purposes herein, the liquid can be water, but also can be any other liquid. While the watercraft 120 is moving, the system 110 can determine the transferred water amount, that is, the amount, volume, weight and/or other metric of water added to or drained from the ballast tank 106 by the pumps 104 and 107. Based on the static water amount and the transferred water amount, the controller 102 determines the total amount of water in the ballast tank to provide an accurate reading of that total amount and optionally a corresponding attitude of the watercraft.

Figure 4:
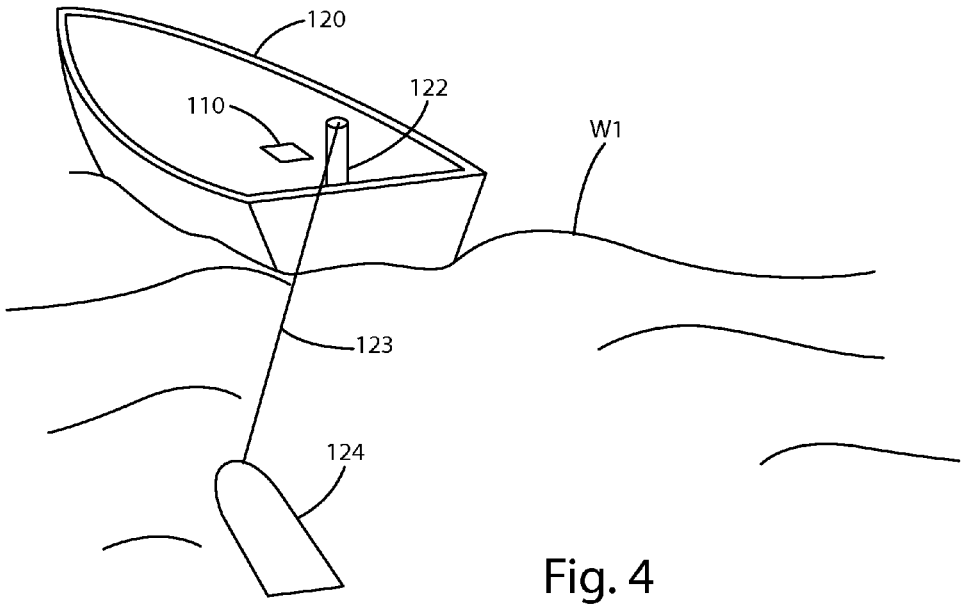
FIG. 4 is rear perspective view of a recreational watercraft, including the ballast system, generating a first wake.
Figure 5:
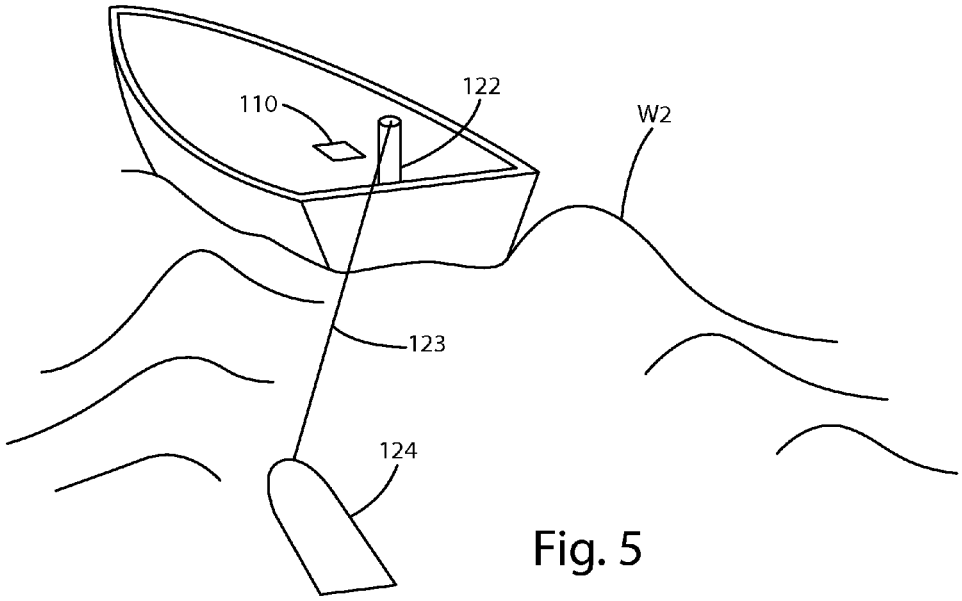
FIG. 5 is another rear perspective view of the recreational watercraft, including the ballast system, generating a second, different wake due to an altered attitude of the watercraft achieved with the ballast system.

Generally, the ballast system 110 and its components can be used in connection with a watercraft 120. As shown in FIG. 4, the watercraft 120 can be a recreational watercraft or a performance watercraft. Of course, the system and methods herein can be used on other types of watercraft, such as personal watercraft, ships, barges, submersible vessels, military watercraft, fishing boats, drilling rigs or other types of sea-faring devices. The watercraft also can include a structure, such as a pole or tower 122, to which a tow line 123 is connected. The tow line can extend to a watersport athlete riding a wakeboard 124 or other recreational implement such as waterskies, a ski board, or the like.

With the ballast system 110 and method of the current embodiment, an operator of the watercraft 120 can adjust the attitude of the watercraft, generally, the depth to which it sits in the water, or generally the amount of water that the boat displaces in the surrounding water. Of course, such attitude adjustment can also uniquely alter the starboard to port level or lay of the watercraft in the water, and/or the bow to stern level or lay of the watercraft in the water. By so doing, when and while the watercraft is in motion, the operator can change the wake of the boat from a first wake W1 shown in FIG. 4 to a second, different wake W2 shown in FIG. 5. Generally, virtually any size or shape of wake can be created within the limits of the hull configuration of the watercraft and other features of the watercraft.

With the ballast system 110, the user can manually adjust the wake behind the watercraft to a variety of different wakes depending on the particular sport and/or the preferences of the watersport athlete being towed behind the boat on the implement 124. In the first alternative embodiment as explained below, the ballast system and method operate in an automatic mode 110 in which a preset level or attitude is entered by an operator, and in which the system automatically operates the fill and/or drain pumps to alter the amount of liquid in the ballast tank, thereby adjusting the attitude of the watercraft to a desired attitude corresponding with the preset level or attitude.

As used herein, the ballast system and related methods are described in connection with water added to or drained from the ballast tank. The "water" can be any type of water, such as fresh water, sea water, pond water, lake water or any other type of liquid that a watercraft can or might float in. Further, as used herein the water is described in terms of some "amount," which can be any volume of water, weight of water, level of water, displacement of water, amount of water (in any units, for example, pounds, gallons liters, etc.) or any other way in which water or liquid can be measured and/or quantified. As described herein, the controller can monitor or otherwise sense one or more "pump conditions," which can include, but are not limited to, the run time of a pump, the inflow or outflow of liquid to or from the pump, vacuum created by the pump, pump pressure or head, the power output of a pump, RPMs of a pump, power draw of the pump, or any other condition associated with the pump and/or the plumbing system associated with the ballast tank. Optionally, the system can include separate flow meters in fluid communication with the pumps to assist the controller in determining the amount of water transferred to or from the ballast tank.

II. Construction

Figure 3:
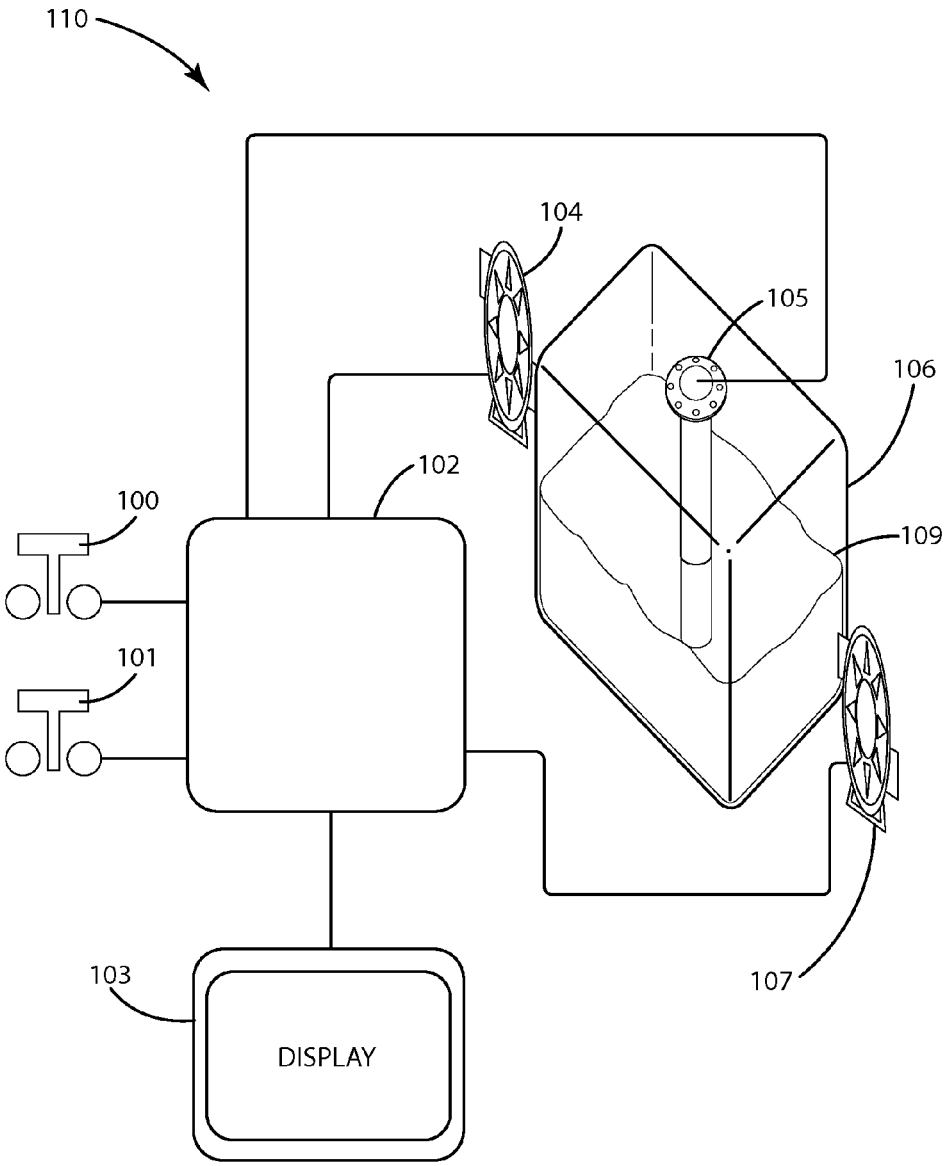
FIG. 3 is a schematic of a ballast system of a current embodiment.

The construction of the ballast system 110 is shown with its components in FIG. 3. There, the system 110 includes a ballast tank 106. The ballast tank can be a conventional cuboid ballast tank, but of course, can be of virtually any size or shape. For example, the ballast tank can be polygonal, triangular or other shapes configured to fit well within the hull of the watercraft. The ballast tank also can be a flexible, shape and/or size changing bag, membrane or other container constructed from a polymeric or other material. There also may be multiple ballast tanks and fill pumps on the watercraft.

A sensor 105 is associated with the ballast tank and at least partially projects within the interior of the ballast tank. The sensor is adapted to measure and/or take readings of the amount of the liquid or water 109 in the ballast tank. The sensor 105 can be a float type sensor, a flap type sensor, a pneumatic sensor, and/or a pressure transducer. Where the ballast tank is a flexible membrane or bag type ballast tank, the sensor can be in the form of a pressure transducer to offer additional helpful input over a conventional reed switch sensor. For example, a pressure transducer can output information and data in analog form, and can take an infinite number of readings of the amount of water in the tank. In turn, this sometimes can provide more precise data regarding the water amount for the controller to use.

A potential issue with the pressure transducer, however, is that when a pump, for example, the drain pump is actuated, that pump sometimes can create a vacuum above the water within the tank. This can lead to an inaccurate reading of the water amount by the pressure transducer. This error, however, can be addressed by calibrating the pressure transducer to accommodate for the vacuum created by the pump in the ballast tank. Alternatively or additionally, the error created by the vacuum can be addressed by intermittently turning off the drain pump during a drain condition. While the drain pump is off, the pressure sensor can measure or sense the pressure of water in the ballast tank. The controller can acquire the data related to the pressure, and then turn the drain pump back on. The measured or sensed pressure, and thus the amount of the water in the tank using such a process, sometimes can be more accurate. Either way, any type of sensor capable of determining the amount of water in the ballast tank can be implemented with the current embodiments.

The pumps 104 and 107 can be in fluid communication with the ballast tank 106 and some source of water, for example, the water surrounding the watercraft, in which the watercraft is floating, with piping and/or conduits. These pumps can operate to fill and/or drain liquid from the ballast tank.

Generally the plumbing system, that is the pumps 104 and 107, and any conduits associated therewith can be calibrated and characterized so that the controller 102 can effectively and accurately determine the amount of water transferred to or from the ballast tank 106 with those pumps. There are a variety of different pumps for different watercraft OEMs. Therefore, each plumbing system, and set of pump conditions, uniquely associated with particular OEMs and models of watercraft, can be characterized and calibrated for the controller to operate efficiently and accurately. The information concerning the pumps, that is, the data associated with certain pump conditions, can be tested and recorded in controllers or associated memory.

The pumps 104 and 107 can be in electrical communication with the controller 102. This communication can be via a hard wired harness, or optionally via a wireless system. The pumps also can be in communication with the pump switches 100 and 101 so that an operator of the watercraft can actuate the switches to thereby drain or fill water from the ballast tank 106 with the drain pump 107 and/or fill pump 104. The switches 100 and 101 can be buttons, levers or other actuators easily accessible by the operator of the watercraft while the watercraft is moving. Optionally, the switches are in proximity to the operator so that the operator can operate them while driving the watercraft with a steering mechanism. Further optionally, the switches can be implemented in a touch screen in a dashboard of a watercraft. If desired, the switches 100 and 101 can be included in the display 103, and the display can be a touch sensitive display.

The controller 102 can be a microprocessor, however, any other type of computing device can be substituted for it. The controller 102 interfaces with the electronic system and/or BUS of the watercraft to monitor a variety of different operating systems and data on the watercraft. As mentioned above, the controller can monitor pump conditions to determine the amount of transferred water that is added to or drained from the ballast tank, and other information regarding the static baseline water amount. The controller also can perform part or all of the methods described below.

III. Ballast System Method

The method of operation of the ballast system will now be described with further reference to FIGS. 6-10. Generally, many of the steps in the ballast system method 130 shown in FIG. 6 are performed by the controller 102. Of course, there can be input fed to the controller from the operator via the display or the switches related to the pumps. Information, data and other operating parameters can be monitored by and/or fed to the controller from other systems on the watercraft in communication with the controller.

In method 130, shown in FIG. 6, the controller determines whether the watercraft is static or generally not moving. In step 131, the controller generally determines whether the watercraft is moving at a speed less than about 2 MPH or optionally less than about 5 MPH. Of course other speeds can be selected. The controller can do so by monitoring the speed of the watercraft in another electronic system of the watercraft. Alternatively, instead of monitoring speed, the controller can monitor the RPMs of the watercraft engine, airflow into the engine or some other parameter that enables the controller to generally make a determination whether the watercraft is static or not.

Upon determining that the watercraft is in a static state, that is, not moving much, the controller determines the static baseline water amount in the ballast tank while the watercraft is in that static condition. This step 132 can be called or begun by the controller at the event of an ignition circuit powering up the watercraft. It generally establishes the amount of water in the ballast tank while the boat is in the static state, that is, at rest or moving very slowly in the water. This can be performed by the sensor 105 actively or passively communicating the amount of water 109 in the tank 106 to the controller 102, or a value or signal associated with that amount. Where the sensor is a pressure transducer, a pressure reading value or signal can be transmitted to the controller and the controller can compute the precise or relative amount of water in the ballast tank.

Figure 7:
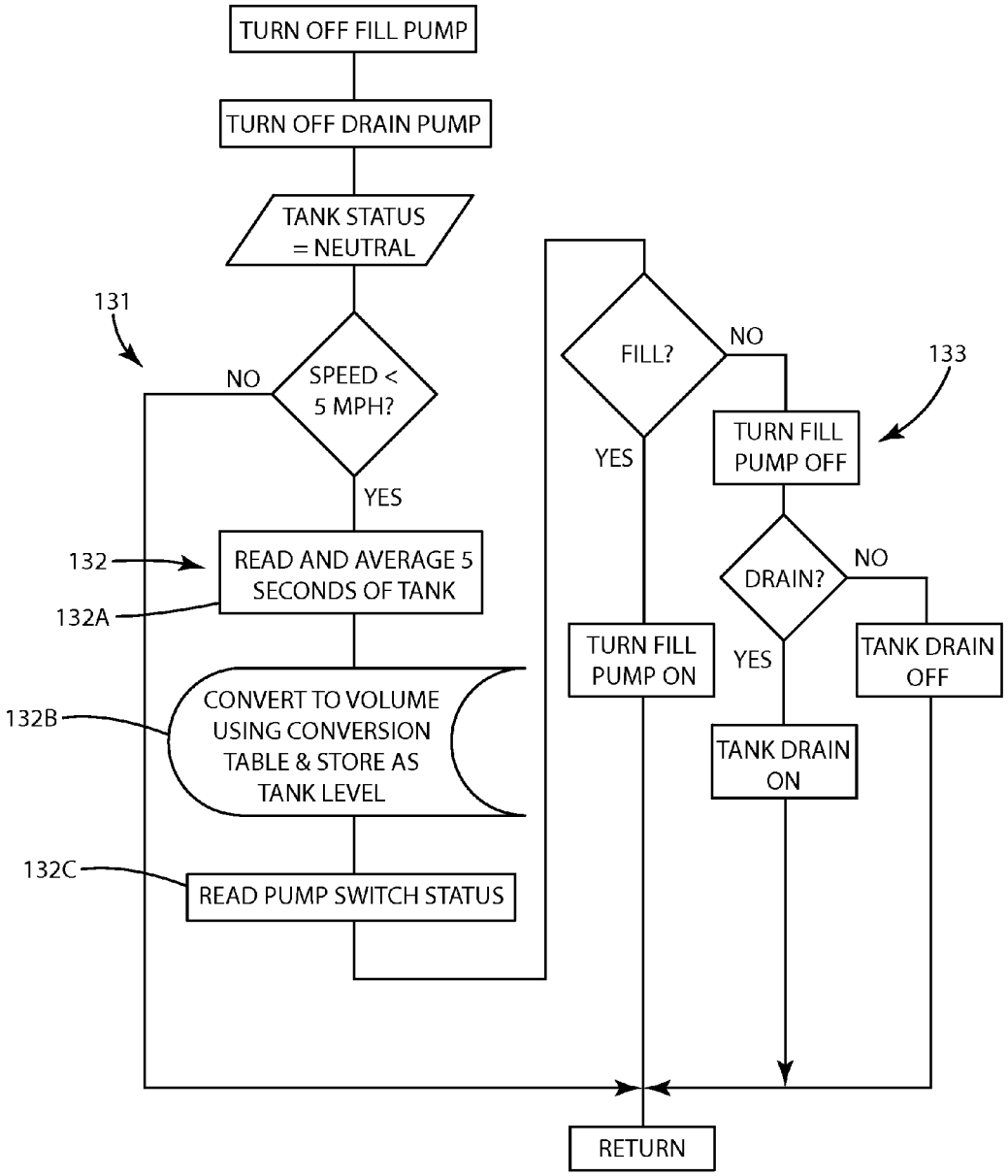
FIG. 7 is a flow chart illustrating operation of a tank level function carried out by the controller, invoked at each ignition of the watercraft, while the watercraft is in a static state.

A more particular example of steps 131 and 132 is illustrated in FIG. 7. There, the controller goes through a series of steps starting with turning off the fill pump and turning off the drain pump. This results in the controller identifying a tank status NEUTRAL reading. The controller can turn the tank status to a setting of NEUTRAL upon the ignition or some other predefined event. In step 131, the watercraft engine RPM is checked by the controller for a condition of less than 850 RPM (although other RPMs can be selected depending on the application) and a condition of the boat moving through the surrounding water at less than 5 MPH, optionally less than 3 MPH, further optionally less than 2 MPH. The RPM can come from the operating system of the watercraft, and the speed can come from a GPS or other component of the operating system. Again this information can signify that the boat is in a static state. Incidentally, this check can be helpful because the ignition might be cycled by the operator while the boat is in an aggressive dynamic motion, which would reset the baseline water amount to a false value or reading.

If the watercraft is not in a static state at ignition on, the function returns without processing, measuring or determining a static baseline water amount, again because this would likely lead to a false value or reading. If the boat is in a static state, a signal from the sensor 105 is sampled and averaged for a period of 5 seconds in step 132A. The average is converted to an amount of water using a transformation of the level and the ballast tank geometry in step 132B, optionally by the controller. The measured amount of ballast water is stored in the processor memory as the Tank Level, which corresponds to the static baseline water amount.

Figure 8:
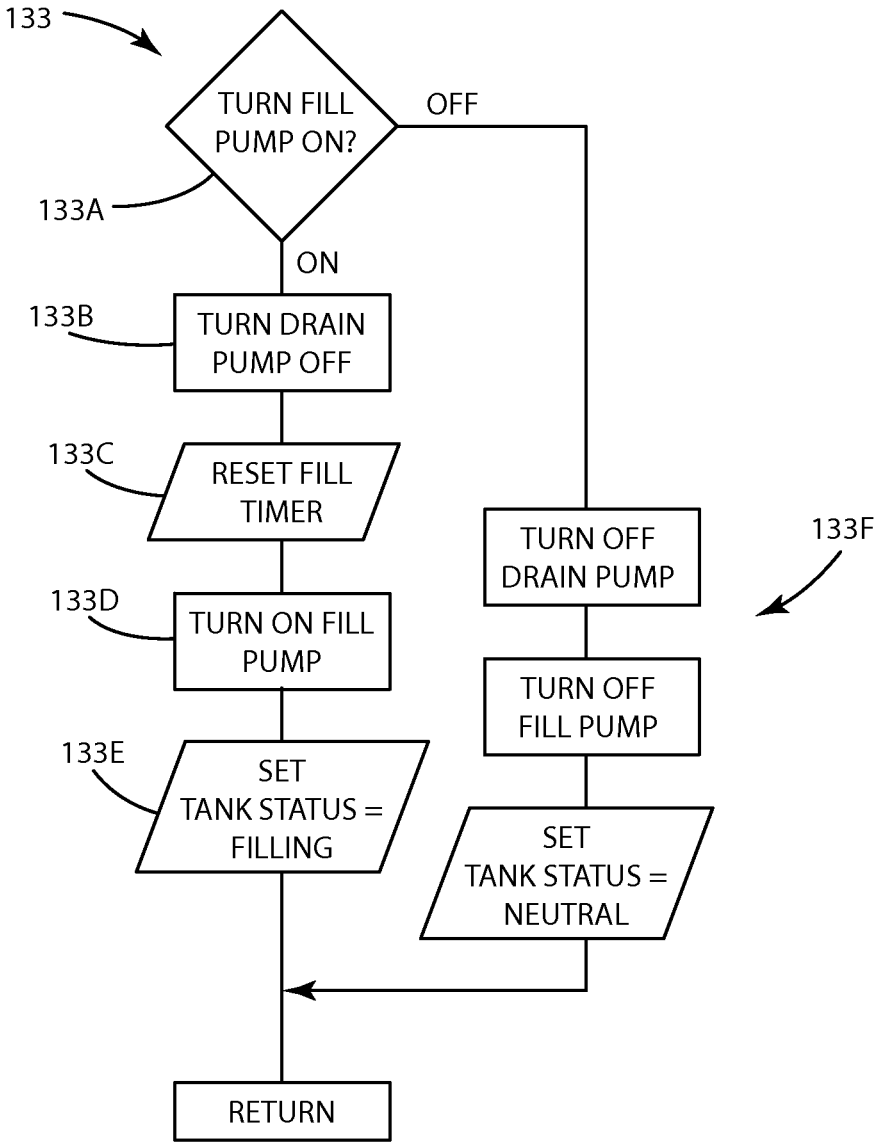

The fill and drain switches are read by the controller to determine if a user has requested a fill or drain pump to activate. As illustrated in step 133 of FIG. 7, as well as FIGS. 8 and 9, if the fill switch has been activated, then an event function turn fill pump on shown in FIG. 8 initiates to turn on the fill pump. If the fill switch is not active, the event function turn fill pump off will be invoked to turn off the fill pump. Within step 133, the controller checks the drain switch similar to the checking of the fill switch as mentioned immediately above. As shown in FIG. 8, the controller checks if the then requested turn on the fill pump is true. If it is true, the drain pump is turned off in step 133F. The fill timer is reset in step 133C and enabled to count. The fill pump is turned on in step 133D. The tank status is then set by the controller to FILLING to inform the controller of the pump state in step 133E.

Generally, in steps 133C-133F, the controller monitors the pump condition of the fill pump and/or the drain pump. In so doing, in particular, the pump condition monitored is the amount of time the fill pump runs. The amount of pump run time is then manipulated in a mathematical transform or firm ware conversion table (that is, a lookup table) that converts the pump run time to a volume or other amount of water transferred. The mathematical transform can use the rate of water flow multiplied by the time to determine the transferred amount of water, for example, the transferred volume of water. The transferred amount of water can be stored in a memory associated with or accessible by the controller for further use as described below. Alternatively, a flow rate counter can be implemented in the plumbing system to determine the transferred amount of water pumped into or from the ballast tank.

The steps 133A-133F if in FIG. 8 can be initiated by the controller at the event of an actuation of a switch 100 by the operator to turn a fill pump on or off and to start a timed event for a fill operation by the pump. If the controller receives the event request to turn off the fill pump in step 133F, the fill pump is turned off. The drain pump is also turned off although it should not have been running in the first place. Tank status is set to NEUTRAL to inform the operator of the pump state, optionally through the display 103.

Figure 9:
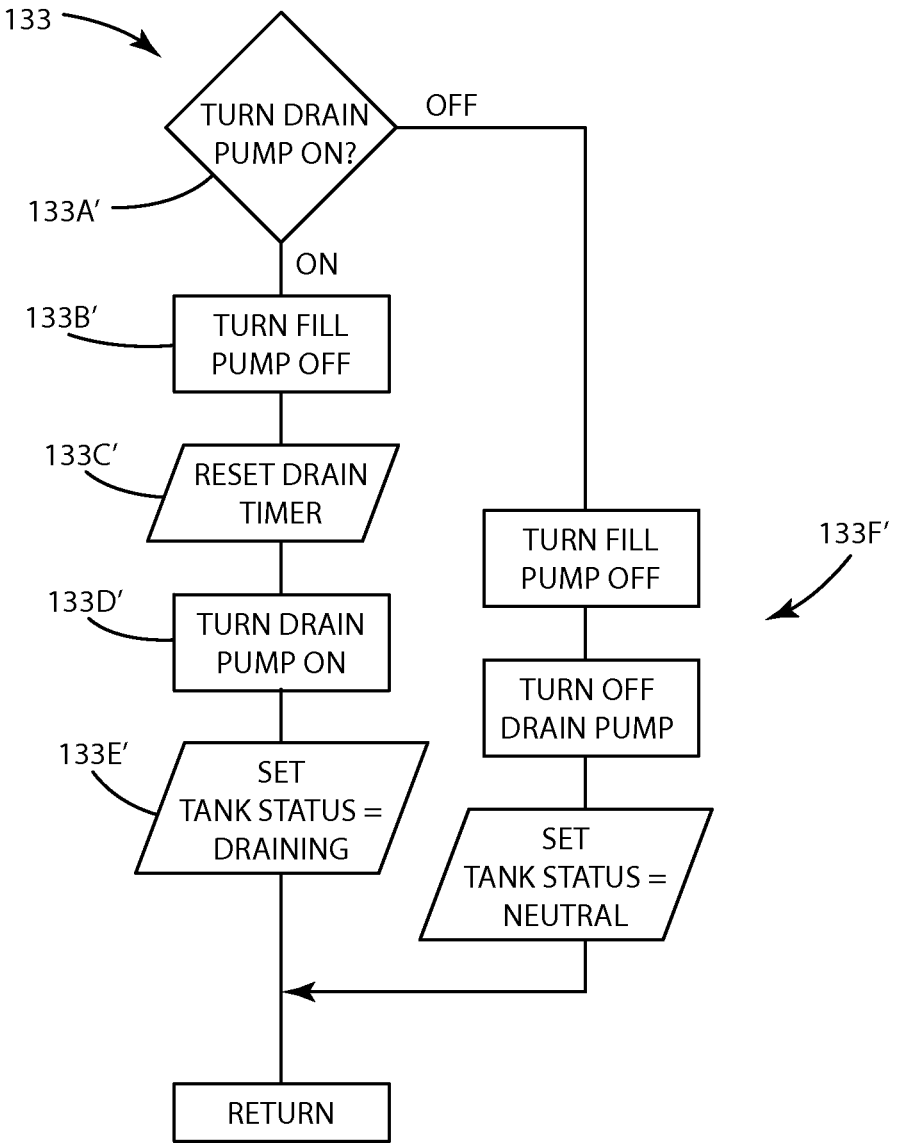
Figure 10:
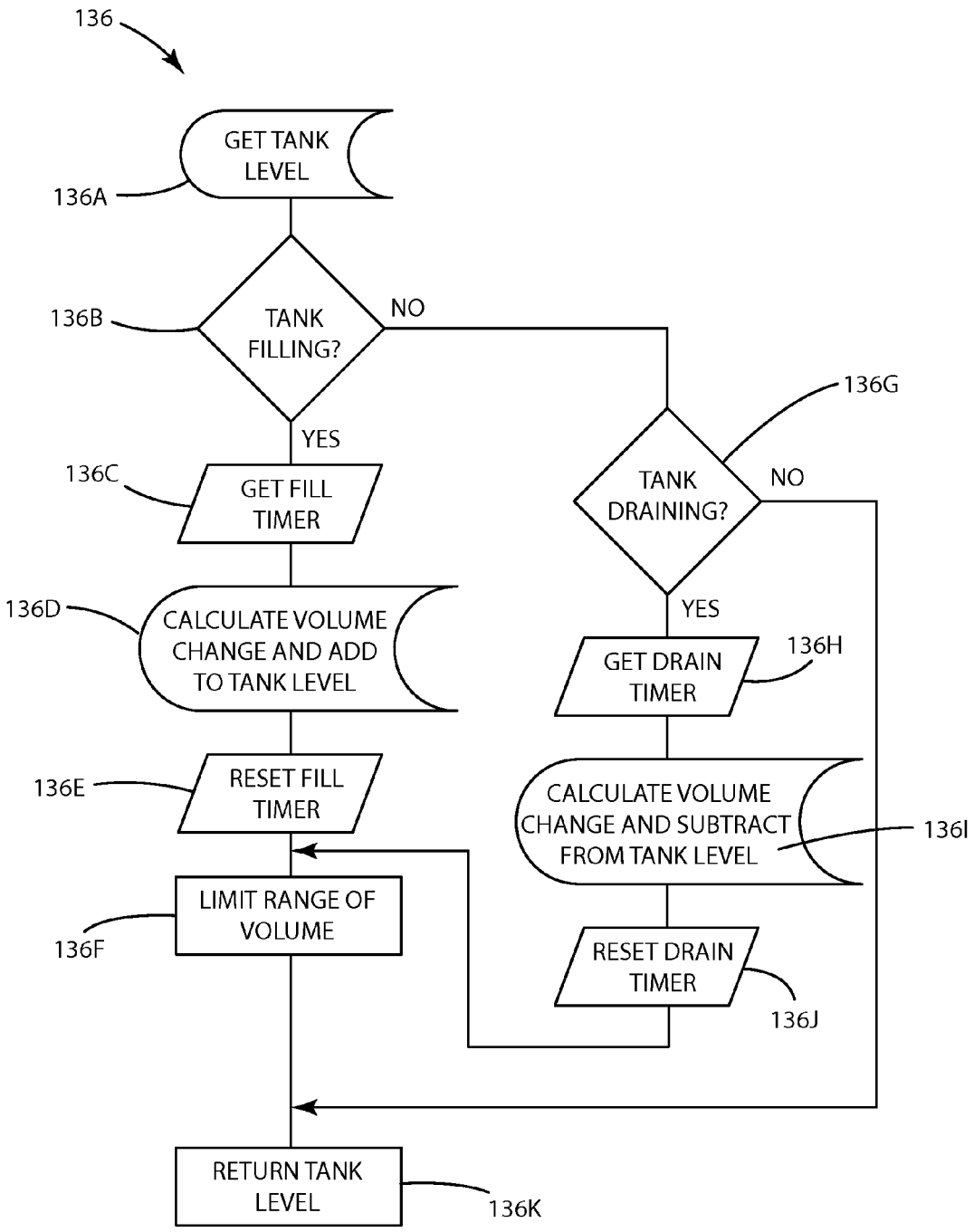
FIG. 10 is a flow chart illustrating operation of the controller periodically determining the amount of water transferred to or from the ballast tank, to determine the current tank level.

The steps 133A'-133F' in FIG. 9 can be initiated at the event of an operator actuating a switch to turn a drain pump on or off, and to start a timed event for a drain operation. In steps 133A'-133F', the controller checks if the event requested, turn on the drain pump is true. If true, then the pump is turned off in step 133B'. The drain timer is reset in step 133C' and enabled to count, again to calculate the amount of time that the drain pump runs which data is then used by the controller to determine the transfer amount of water drained from the ballast tank. The drain pump is turned on. The tank status is then set to DRAINING to inform the operator of that pump state. Again, this status can be output via the display 103 if desired. If, however, the controller receives the event requested to turn off the drain pump, the drain pump is turned off in step 133F'. The fill pump also is turned off although it should not have been running in the first place. The tank status is set to NEUTRAL and this is output to the user optionally via the display to inform the user of the pump state.

Returning to FIG. 6, in step 134, the controller determines the transferred amount of water added to or drained from the ballast tank, while the watercraft is in a dynamic state. This can be calculated by the controller based on the drain timer data and the utilization of a mathematical transform or other operation to compute the transferred amount of water. In step 135, the controller determines the total amount of water in the ballast tank after the transfer is complete, or in some cases, while the transfer is occurring to provide real time output of the transfer if desired. Again, this output can be displayed on the display 103 to the operator.

In determining the total amount of water in the ballast tank after transfer, the controller sums the static baseline water amount, taken when the watercraft was in a static state, and the transferred amount of water added or drained from the ballast tank while the watercraft is in a dynamic state. After the transferred amount of water is added to or subtracted from the static water amount, a total water amount is determined by the controller. This total water amount can be output to the operator in a variety of different manners in step 137. For example, the controller can communicate a value representative of a total amount of water (or any of the other amounts of water such as the static water amount and/or the transferred amount of water) for display on the display 103. The display is viewable by the watercraft operator so that they can appreciate the total amount of water in the ballast tank. Optionally, the total amount of water can be output as a volume of water (for example, in gallons, liters and/or cubic feet) in a ballast tank, a percentage full or empty of the ballast tank and/or a weight of the water in the ballast tank. Optionally, a displayed output can be in the form of the weight of water in the ballast tank, which is many times suitable for wakeboarding and/or waterskiing activities.

All of steps 133, 134, 135, 137 and other related steps can and are typically all carried out and performed by the controller while the watercraft is in a dynamic state, moving greater than about 2 MPH or greater than about 5 MPH through the surrounding water within which the watercraft is located.

Optionally, the method, and in particular the determination of the transferred amount of water, can be carried out when the watercraft is moving in the dynamic state within certain speed ranges or less than certain speeds. For example, when the watercraft is moving through rough or choppy water, the fill pump may draw in air along with the water. This can occur where the intake for the fill pump (usually located on the bottom of the watercraft) comes out of the water at higher speeds. When air is drawn in with the water, the actual amount of water drawn in by the fill pump and filled to the ballast tank (that is, the transferred amount of water) might be less than what is determined by the controller. This can happen where the controller times the operation or run time of the pump. Although the pump is running during that time, the controller does not sense whether water is actually being transferred to the pump. To address this issue, the controller can prevent or impair any fill operations, and corresponding fill pump activation, when the watercraft is moving faster than a predetermined speed, for example, faster than about 35 MPH or about 45 MPH, or at some other speed where cavitation or intake of air by the pump becomes an issue.

With the method herein, an operator and/or watersport athlete can easily obtain the desired attitude of the watercraft to provide a desired wake W2 behind the watercraft while the watercraft is in a dynamic state moving through the surrounding water. As an example, a watersport athlete can provide instruction to an operator before or while being towed behind the watercraft to adjust the attitude to a certain weight of water (pounds) which corresponds to a desired attitude of the watercraft. The operator can actuate the fill switch or drain switch, which actuate the respective fill or drain pumps. The controller monitors the transferred amount of water and outputs the total amount of water in the ballast tank, accounting for both the transferred amount of water and the static baseline water amount previously determined. The operator can monitor that output on the display, and can continue to actuate either the fill switch or the drain switch until the reading on the display is the amount specified by the watersport athlete. When this is achieved, the operator and watersport athlete can be confident that the amount of water in the ballast tank is clearly what is output by the display, and that the desired attitude of the boat is achieved to provide the size and shape of wake preferred by the watersport athlete and/or the operator.

This system and method can enable watersport athletes to call out desired attitudes of the boat, for example, in the form of the weight of water in the ballast tank. The operator can then manually set the water in the tank to that amount and provide the desired wake—even while the boat is in motion in a dynamic state. Previously, this was not possible because the sensors of conventional ballast systems could not accurately account for the amount of water transferred to or from the ballast tank, particularly when the boat was moving, because the sensor would provide false readings. Thus, the present embodiments provide a surprising and significant leap in ensuring the accuracy and precision with which ballast tank levels are monitored, and thus optionally, the precision with which the attitude of a boat and corresponding wake behind the watercraft are adjusted.

Optionally, the ballast system, and particularly the controller, can periodically sample fill and drain conditions to calculate and recalibrate the ballast tank total amount of water. This can ensure consistent and accurate readings of that total amount of water. As an example shown in FIG. 10, step 136 is implemented. In this step 136, the controller includes a time-based driven scheduler on a schedule. The timing of the call is made within a time period shorter than the capacity of the controller timer values to ensure there is never an overrun timer. Timers are used to time the "on time" of the ballast fill and/or drain pumps. The pump run time is used to calculate the amount of water added or subtracted (that is, filled or drained), respectively from the ballast tank. Similar to the above embodiment, the controller utilizes the rate of water flow multiplied by the time to determine the transferred amount of water.

As shown in step 136B, a determination is made whether the tank is filling. If it is, in step 136C, the timer is run on the fill pump, that is, the controller monitors a pump condition. The controller in step 136D calculates the volume change and adds that to the tank level. In step 136E, the fill timer is reset. In step 136F, the range of volume is limited for the fill pump. In step 136G, a determination is made whether the tank is draining via operation of the drain pump. If it is, the drain timer is run in step 136H. In step 136I, the amount of water change is determined and subtracted from the tank level amount, that is, the transferred water amount is subtracted from the static baseline water amount determined when the watercraft was in a static state. In step 136J, the drain timer is reset. Ultimately in step 136K, the total volume of water in the ballast tank is set as the tank level for further calculations, particularly where the fill pump and/or drain pump are operated to again transfer water to or from the tank when adjusting the attitude of the watercraft. Optionally, the controller can be set to output or specifically display on the display the estimated amount of time to achieve a particular attitude adjustment, a ballast preset level or an estimated time to empty or fill the ballast system. It also can display an estimated time to achieve a certain weight, volume or percent full or empty, even while the watercraft is in a dynamic state, for example, in motion towing a watersport athlete behind the watercraft.

Further optionally, in some cases, the ballast system and method can include or implement a micro-electromechanical system (MEMS) that can detect, sense or determine the tilt, rotation, acceleration or other characteristics of the watercraft. In turn, this can assist in further determining the actual attitude of the watercraft, and adjust the attitude more accurately and/or more consistently. As an example, a MEMS sensor can measure the pitch and/or yaw of the watercraft. This measurement can be in the form of the inclination of the watercraft and/or ballast tank relative to longitudinal and lateral axes extending through a horizontal reference plane that optionally intersects the ballast tank. The controller can take this measurement of pitch and/or yaw, and correlate it with the level of the water in the tank as sensed by another fluid level sensor, such as a reed or float type sensor. The controller can then determine the theoretical plane of the surface of the water in the ballast tank at the MEMS measured pitch or yaw. Then the controller can determine the volume and/or amount of water under the theoretical plane at the sensed level, taking into account the tank geometry and the pitch and/or yaw of the watercraft. Based on this, the controller sometimes can more closely determine the actual total amount of water in the ballast tank.

Figure 11:
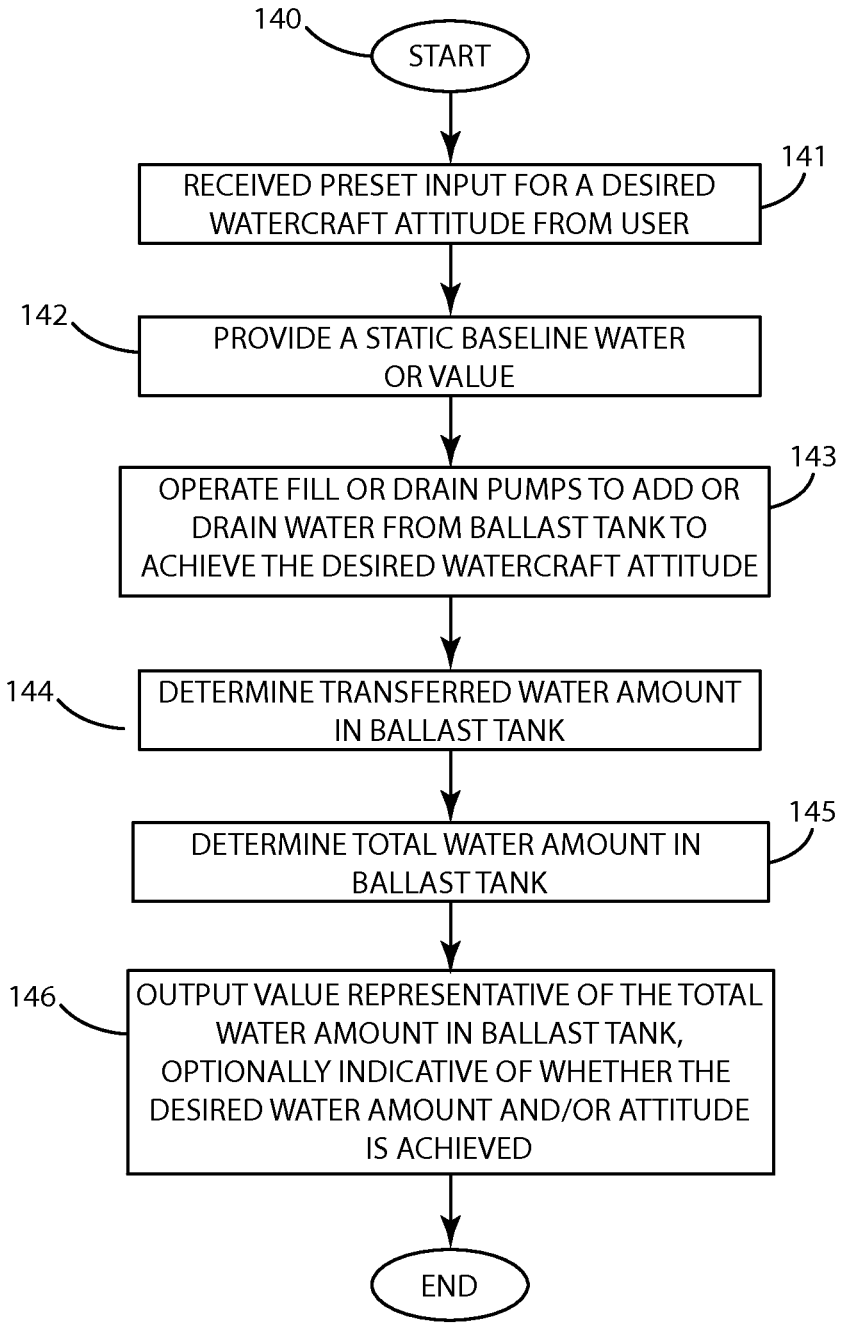
FIG. 11 is a flow chart illustrating operation of the ballast system under a method of a first alternative embodiment.

A first alternative embodiment of the system and method is illustrated in FIG. 11 and generally designated 140. This method is similar to the above system and method in most regards with a few exceptions. For example, in step 141, an operator can input a preset level or input for the ballast associated with the amount of water in the ballast tank and a desired attitude of the watercraft, and thus a desired wake behind the watercraft. The input can correlate to, for example, a preselected weight, gallons in or percent full of the ballast tank. The preset input can be associated with data stored by the controller in a memory module associated with the controller. In step 142, the controller can provide a static baseline water amount or value which represents the amount of water in the ballast tank when the watercraft is in the static state. Again, this static baseline water amount can be calculated using the methods and steps noted above.

The controller can then compare the baseline water amount or value to the preset input by the user and received by the controller. Based on this, or some other calculation, the controller can determine the amount of water to be transferred to or from the ballast tank to achieve a total amount of water that corresponds to the preset. In step 143, the controller operates the fill or drain pumps automatically to add or drain water from the ballast tank to achieve the total amount of water based on the preset, and thus the desired watercraft attitude. Optionally, the desired watercraft attitude can be associated with the corresponding amount of transferred water.

While the controller controls the pump(s), the controller can determine the transferred water amount in the ballast tank in step 144 and continuously update the total water amount in the ballast tank in step 145. Again, when the total water amount and the ballast tank correspond to the preset input or level, the system can output that information to the operator. As an example, the controller can output a value representative of the total water amount in the ballast tank indicative of whether the desired watercraft attitude is achieved, or alternatively that the desired weight, volume, percent full or empty, or other value corresponding to the preset is achieved. Further, as mentioned in the embodiment above, the controller can also output via the display the estimated amount of time to achieve the preset level and/or the estimated amount of time change in the attitude of the watercraft in the surrounding water.

With the ability to automatically adjust the attitude of a watercraft to a preset value, a watersport athlete can instruct an operator of the watercraft to adjust the attitude of the boat so that the desired size and shape of wake is provided behind the watercraft, thereby enabling the watersport athlete to perform the watersport activity.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. A method of operating a ballast system of a watercraft, the method comprising:

determining a static baseline water value representative of a first amount water in a ballast tank on a watercraft with a sensor while the watercraft is in a static state;

storing the static baseline water value in a memory;

determining a transferred water value representative of a second amount of water that is at least one of added to and drained from the ballast tank while the watercraft is in a dynamic state by monitoring a pump condition with a controller;

determining an output value representative of a total amount of water in the ballast tank while the watercraft is in a dynamic state with the controller, the total amount of water including the first amount of water associated with the static water value and the second amount of water that is at least one of added to and drained from the ballast tank represented by the transferred water value; and activating at least one pump to at least one of add water to and to drain water from the ballast tank to alter the attitude of the watercraft relative to the surrounding water within which the watercraft is located while the watercraft is moving, thereby altering at least one of the shape and size of wake behind the watercraft, whereby a watersport user towed behind the watercraft can engage the altered wake.

2. The method of claim 1 wherein the output value is in the form of at least one of a water volume, a water weight and a percentage of ballast tank full.

3. The method of claim 2 comprising displaying the output value to an operator of the watercraft and an estimated time for a desired total amount of water in the ballast tank to be achieved.

4. The method of claim 1 comprising receiving an input representative of a preselected total amount of water in the ballast tank to achieve a desired attitude of the watercraft in surrounding water within which the watercraft is located.

5. The method of claim 4 comprising activating the at least one pump to at least one of add water to and to drain water from the ballast tank to achieve the preselected total amount of water, whereby the watercraft achieves a desired attitude relative to the surrounding water within which the watercraft is located.

6. The method of claim 1 comprising:

monitoring a pump run time;

determining the transferred water value based on the pump run time; and adding or subtracting the transferred water value relative to the static baseline water value to determine the output value.

7. The method of claim 1 comprising:

monitoring a flow rate of a pump;

determining the transferred water value based on the flow rate; and adding or subtracting the transferred water value relative to the static water value to determine the output value.

8. The method of claim 1 comprising receiving input associated with an attitude of the watercraft, and automatically altering the total amount of water in the ballast tank while the watercraft is in a dynamic state, wherein a desired attitude of the watercraft is achieved to provide a desired wake behind the watercraft when the watercraft is in the dynamic state.

9. A method of operating a ballast system of a watercraft, the method comprising:

determining whether a watercraft is in a static state;

determining a static water amount in a ballast tank on the watercraft while the watercraft is in the static state with a controller;

storing a static water amount value representative of the static water amount in a memory;

monitoring at least one of a fill condition, in which water enters the ballast tank, and a drain condition, in which water leaves the ballast tank, while the watercraft is in a dynamic state, moving through surrounding water;

determining a transferred amount of water that is at least one of transferred to and transferred from the ballast tank during the at least one of a fill condition and drain condition;

displaying to a user with a display a displayed value representative of the total amount of water in the ballast tank while the watercraft is in the dynamic state, the displayed value accounting for both the static water amount and the transferred amount of water so as to provide an accurate reading of the total amount of water in the ballast tank regardless of movement of the total amount of water in the ballast tank;

wherein the user can review the display and alter the amount of water in the ballast tank based on the displayed value by at least one of filling and draining water from the ballast tank while the watercraft is in the dynamic state so that the attitude of the watercraft is adjusted as the watercraft moves through surrounding water; and wherein in the dynamic state, the watercraft is moving greater than 2 MPH, and towing a watersport athlete behind the watercraft.

10. The method of claim 9 wherein the displayed value is in the form of at least one of the amount of water in the ballast tank, a percentage full of the ballast tank, and a weight of water in the ballast tank.

11. A method of operating a ballast system of a watercraft, the method comprising:

determining whether a watercraft is in a static state;

determining a static water amount in a ballast tank on the watercraft while the watercraft is in the static state with a controller;

storing a static water amount value representative of the static water amount in a memory;

monitoring at least one of a fill condition, in which water enters the ballast tank, and a drain condition, in which water leaves the ballast tank, while the watercraft is in a dynamic state, moving through surrounding water;

determining a transferred amount of water that is at least one of transferred to and transferred from the ballast tank during the at least one of a fill condition and drain condition;

displaying to a user with a display a displayed value representative of the total amount of water in the ballast tank while the watercraft is in the dynamic state, the displayed value accounting for both the static water amount and the transferred amount of water so as to provide an accurate reading of the total amount of water in the ballast tank regardless of movement of the total amount of water in the ballast tank;

wherein the user can review the display and alter the amount of water in the ballast tank based on the displayed value by at least one of filling and draining water from the ballast tank while the watercraft is in the dynamic state so that the attitude of the watercraft is adjusted as the watercraft moves through surrounding water;

receiving input from the user, the input associated with an attitude of the watercraft and automatically altering the amount of water in the ballast tank while the watercraft is in the dynamic state, moving through the surrounding water, whereby a desired attitude of the watercraft is achieved to provide a desired wake behind the watercraft when the watercraft is in the dynamic state, moving through the surrounding water.

12. A method of operating a ballast system of a watercraft, the method comprising:

determining whether a watercraft is in a static state;

determining a static water amount in a ballast tank on the watercraft while the watercraft is in the static state with a controller;

storing a static water amount value representative of the static water amount in a memory;

monitoring at least one of a fill condition, in which water enters the ballast tank, and a drain condition, in which water leaves the ballast tank, while the watercraft is in a dynamic state, moving through surrounding water;

determining a transferred amount of water that is at least one of transferred to and transferred from the ballast tank during the at least one of a fill condition and drain condition;

displaying to a user with a display a displayed value representative of the total amount of water in the ballast tank while the watercraft is in the dynamic state, the displayed value accounting for both the static water amount and the transferred amount of water so as to provide an accurate reading of the total amount of water in the ballast tank regardless of movement of the total amount of water in the ballast tank;

wherein the user can review the display and alter the amount of water in the ballast tank based on the displayed value by at least one of filling and draining water from the ballast tank while the watercraft is in the dynamic state so that the attitude of the watercraft is adjusted as the watercraft moves through surrounding water;

monitoring a pump condition and determining the displayed value based on the pump condition; and displaying on the display an estimated time to achieve a desired amount of water in the ballast tank.

13. A method of operating a ballast system of a watercraft, the method comprising:

determining whether a watercraft is in a static state;

determining a static water amount in a ballast tank on the watercraft while the watercraft is in the static state with a controller;

storing a static water amount value representative of the static water amount in a memory;

monitoring at least one of a fill condition, in which water enters the ballast tank, and a drain condition, in which water leaves the ballast tank, while the watercraft is in a dynamic state, moving through surrounding water;

determining a transferred amount of water that is at least one of transferred to and transferred from the ballast tank during the at least one of a fill condition and drain condition;

displaying to a user with a display a displayed value representative of the total amount of water in the ballast tank while the watercraft is in the dynamic state, the displayed value accounting for both the static water amount and the transferred amount of water so as to provide an accurate reading of the total amount of water in the ballast tank regardless of movement of the total amount of water in the ballast tank;

wherein the user can review the display and alter the amount of water in the ballast tank based on the displayed value by at least one of filling and draining water from the ballast tank while the watercraft is in the dynamic state so that the attitude of the watercraft is adjusted as the watercraft moves through surrounding water;

monitoring a pump condition and determining the displayed value based on the pump condition; and wherein the attitude of the watercraft is adjusted to achieve a desired wake behind the watercraft while the watercraft is in the dynamic state.

14. A method of operating a ballast system of a watercraft, the method comprising:

providing a static baseline water value representative of an amount of water in a ballast tank on a watercraft with a controller while the watercraft is in a static state;

receiving from a user an input associated with a desired attitude of the watercraft, at least one of adding and draining an amount of water to or from the ballast tank in response to the input;

determining an output value that represents a total amount of water in the ballast tank while the watercraft is in a dynamic state with the controller, including the amount of water associated with the static water baseline value and the amount of water at least one of added to or drained from the ballast tank; and displaying the output value to the user with a display so that the user can assess whether the desired attitude of the watercraft has been achieved to provide a desired wake behind the watercraft while the watercraft is in the dynamic state, moving through the surrounding water.

15. The method of claim 14 comprising determining a transferred water value associated with the amount of water at least one of added to and drained from the ballast tank while the watercraft is in a dynamic state by monitoring a pump condition with a controller.

16. The method of claim 15 wherein the input is communicated to at least one pump to initiate the at least one of adding and draining an amount of water to or from the ballast tank.

17. A ballast system for a watercraft comprising:

a ballast tank disposed on the watercraft;

a fill pump in fluid communication with the ballast tank and adapted to add water to the ballast tank;

a drain pump in fluid communication with the ballast tank and adapted to drain water from the ballast tank;

a sensor adapted to measure a static water baseline amount of water in the ballast tank while the watercraft is in a static state;

a controller coupled to the sensor, the controller adapted to monitor a pump condition of at least one of the fill pump and the drain pump, the controller adapted to determine an amount of water transferred to the ballast tank by at least one of the fill pump and the drain pump based on monitoring of the pump condition, the controller adapted to determine an output value that represents a total amount of water in the ballast tank while the watercraft is in a dynamic state, including the static water baseline amount and the amount of water transferred to the ballast tank by at least one of the fill pump and the drain pump; and a display coupled to the controller, the display adapted to display the output value to the user, wherein a user can assess whether a desired attitude has been achieved based on the output value to provide a desired wake behind the watercraft while the watercraft is in the dynamic state.

* * * * *